US007695308B2

(12) United States Patent
Allwood et al.

(10) Patent No.: US 7,695,308 B2
(45) Date of Patent: Apr. 13, 2010

(54) CONNECTION MODULE

(75) Inventors: Brent David Allwood, Buttaba (AU); Jeffrey Allan Glen, Birchgrove (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/330,893

(22) Filed: Dec. 9, 2008

(65) Prior Publication Data

US 2009/0239410 A1 Sep. 24, 2009

(30) Foreign Application Priority Data

Mar. 19, 2008 (AU) ..... 2008901358

(51) Int. Cl.
*H01R 4/24* (2006.01)

(52) U.S. Cl. ..... 439/418; 439/402; 439/417

(58) Field of Classification Search ..... 439/418, 439/417, 402

See application file for complete search history.

(56) References Cited

U.S. PATENT DOCUMENTS

| | | | | |
|---|---|---|---|---|
| 3,154,363 | A | 10/1964 | Will | |
| 3,836,944 | A | 9/1974 | Lawson | |
| 3,985,416 | A | 10/1976 | Dola et al. | |
| 4,452,502 | A | 6/1984 | Forberg et al. | |
| 4,891,018 | A | 1/1990 | Afflerbaugh et al. | |
| 4,981,443 | A * | 1/1991 | Suverison et al. | 439/398 |
| 5,067,810 | A | 11/1991 | Bu-Abbud | |
| 5,240,432 | A * | 8/1993 | Daoud | 439/417 |
| 5,567,173 | A * | 10/1996 | Franckx | 439/418 |
| 6,139,352 | A | 10/2000 | Daoud | |
| 6,208,233 | B1 | 3/2001 | Stein, Sr. et al. | |
| D587,200 | S | 2/2009 | Allwood et al. | |
| D587,201 | S | 2/2009 | Allwood et al. | |
| D587,651 | S | 3/2009 | Allwood et al. | |
| 2003/0062191 | A1 | 4/2003 | Miller et al. | |
| 2005/0070147 | A1 | 3/2005 | Hung | |
| 2008/0305675 | A1 * | 12/2008 | Radle | 439/404 |

FOREIGN PATENT DOCUMENTS

| | | |
|---|---|---|
| AU | 784652 | 1/2003 |
| AU | 2006241314 | 12/2006 |
| DE | 32 00 213 | 10/1982 |
| DE | 202 18 374 | 5/2004 |
| DE | 10 2004 037 991 | 11/2005 |
| DE | 10 2006 011 371 | 7/2007 |
| EP | 0 871 245 | 10/1998 |
| EP | 1 039 580 | 9/2000 |
| WO | WO 2007/087845 | 8/2007 |

* cited by examiner

*Primary Examiner*—Tho D Ta
*Assistant Examiner*—Travis Chambers
(74) *Attorney, Agent, or Firm*—Merchant & Gould P.C.

(57) ABSTRACT

A connection module for housing a contact element used to electrically connect wires within the module, the module being formed of first and second parts arranged to interfit so as to define a first set of openings, each being shaped to receive an end section of one of said wires for electric connection to the contact element, which pass into the module from a first end face toward an opposite second end face, the first part having first and second slots in opposed side walls, and the second part having a first protrusion which is received in a first one of the slots to at least partially fill an open end of said first one of said slots to thereby define an aperture to allow a test probe to access the contact element.

8 Claims, 6 Drawing Sheets

CONNECTION MODULE

This application is a claims benefit of Serial No. 2008901358, filed 19 Mar. 2008 in Australia and which application is incorporated herein by reference. To the extent appropriate, a claim of priority is made to the above disclosed application.

FIELD OF THE INVENTION

The present invention relates to wiring connection modules. More specifically, the present invention relates to a connection module for connecting at least two wires.

BACKGROUND OF THE INVENTION

Connection modules have previously been used to electrically connect two or more insulated conductors (hereafter "wires") together. One such module includes a hinged integral housing in which a contact element with three insulation-displacement terminal contacts is arranged. A common end face of the module includes three slots for receiving end sections of the wires which, when so arranged, are pressed into the insulation-displacement terminal contacts by the housing being hinged together.

Starting from this prior art, the invention is based on the technical problem of providing a connection module which can be used in a more flexible manner. It is generally desirable to overcome or ameliorate one or more difficulties of the prior art, or to at least provide a useful alternative.

SUMMARY OF THE INVENTION

In accordance with one aspect of the invention, there is provided a connection module for housing a contact element used to electrically connect wires within the module, the module being formed of first and second parts arranged to interfit so as to define a first set of openings, each being shaped to receive an end section of one of said wires for electric connection to the contact element, which pass into the module from a first end face toward an opposite second end face, the first part having first and second slots in opposed side walls, and the second part having a first protrusion which is received in a first one of the slots to at least partially fill an open end of said first one of said slots to thereby define an aperture to allow a test probe to access the contact element.

Preferably, the second part is reversible such that the first protrusion is adapted to be received in another a second one of said slots to at least partially fill an open end of the second one of said slots to thereby define an aperture to allow a test probe to access the contact element.

Preferably, the second part includes a second protrusion which is received in the second one of the slots to at least partially fill an open end of said second one of said slots to thereby inhibit access to the contact element.

Preferably, the second part is reversible such that the first protrusion is adapted to be received in the second one of the slots to at least partially fill an open end of the second one of said slots to thereby define an aperture to allow a test probe to access the contact element; and the second protrusion is adapted to be received in the first one of the slots to at least partially fill an open end of said first one of said slots to thereby inhibit access to the contact element.

Preferably, the module includes a detachable wall element removably covering at least a second slot in the second end face of the module.

Preferably, when the wall element is removed, a continuous section of wire can be seated in the second slot for electrical connection to the contact element.

Preferably, when the wall element is in place, the second part is adapted to engage with the first part in only a first configuration in which the protrusion registers with the first slot.

Preferably, when the wall element is removed, the second part is adapted to engage with the first part in either a first configuration in which the protrusion registers with the first slot, or a second configuration in which the protrusion registers with the second slot.

Preferably, the second part includes a recess in one side wall which registers with one of the apertures when the parts are fitted together in order to provide access to the contact element.

Preferably, the apertures in the first part are formed by slots in the side walls which face the second part and the second part includes a protrusion, adjacent the recess, which is received in a first one of the slots to fill an open end of the slot and thereby define the first aperture which communicates with the recess.

Preferably, the second part is reversible such that the protrusion is received in a second one of the slots when the parts are interconnected and the recess aligns with the second aperture, defined by the other one of the slots.

Preferably, the module includes a detachable wall element removably covering at least a second opening in the second end face of the module and, when the wall element is in place, the second part is adapted to engage with the first part in only a first configuration, in which the recess registers with the first aperture, and, when the wall element is removed, in either the first or a second configuration, in which the recess registers with the second aperture.

Preferably the housing has three openings in the first end face and the contact element comprises three insulation-displacement terminal contacts, by means of which two wires may be connected with a third wire forming a measuring, testing and/or checking tap, for example.

Preferably, the detachable wall element is arranged on the second end face which is situated opposite the end face and is situated opposite at least one of the first set of openings, so that a continuous channel for at least one wire is created by detaching the wall element. This means that the connection module may be used as a termination module or as a tapping module, as required. A termination module is to be understood here as meaning that the wires end downstream of the insulation-displacement terminal contact, whereas in a tapping module at least one wire runs further through the module. If this function is required, the wall element is detached. If, in contrast, the intention is to terminate the wire, the wall element remains, this having advantages over a continuous opening, particularly with regard to electrical insulation.

In the case where the housing has three openings, and the contact element has three insulation-displacement terminal contacts, two wires, for example, can be terminated and connected to one another, whereas the third wire forms a measuring, testing and/or checking tap.

In a further preferred embodiment, the three insulation-displacement terminal contacts are in each case arranged at an angle of 90° with respect to one another, with the contact element in the housing being arranged with respect to the openings in such a way that the wires are cut at an angle of 45°. This has the advantage that the remaining material thickness of the wire is higher, and this results in improved transmission properties. The 900 angling of the insulation-displacement terminal contacts provides the contact element with greater stability.

Preferably, the first and second parts of the housing form a housing upper part and a housing lower part respectively, which parts are preferably in the form of separate components.

In general, the housing is preferably formed from transparent plastic, in order to check the contact quality visually.

In a preferred embodiment, the three openings in the first end face are situated next to one another, the two outer openings in each case being bounded by a closed cylindrical projection.

In a further preferred embodiment, the two outer openings are in each case bounded by a closed cylindrical projection, which projections are arranged on the housing lower part, the middle opening being formed or bounded by a partially-open cylindrical projection on the housing lower part and an arcuate mating piece on the housing upper part. It should be noted here that partially-open does not necessarily mean 180°. The angle range may instead be considerably larger, for example 270°. In this case, the angle is preferably chosen in such a way that the housing lower part can still hold a laid wire in a simple manner, so that this wire can subsequently be connected using the connection module.

In a further preferred embodiment, two further cylindrical projections are arranged on the second end face in a manner aligned with the cylindrical projections on the first end face.

In a further preferred embodiment, the detachable wall element blocks all three openings on the second end face. However, it is also possible for a separate wall element to be associated with each opening or to block only the middle opening.

In a further preferred embodiment, the wall element is latched to the housing, so that the wall element is detached in a reversible manner. However, structural designs are also feasible where the wall element is provided with predetermined breaking points and is broken out of the housing lower part in an irreversible manner.

BRIEF DESCRIPTION OF THE DRAWINGS

Preferred embodiments of the invention will now be described, by way of example only, with reference to the accompanying drawings, in which.

DETAILED DESCRIPTION OF PREFERRED EMBODIMENTS OF THE INVENTION

Figure 1:
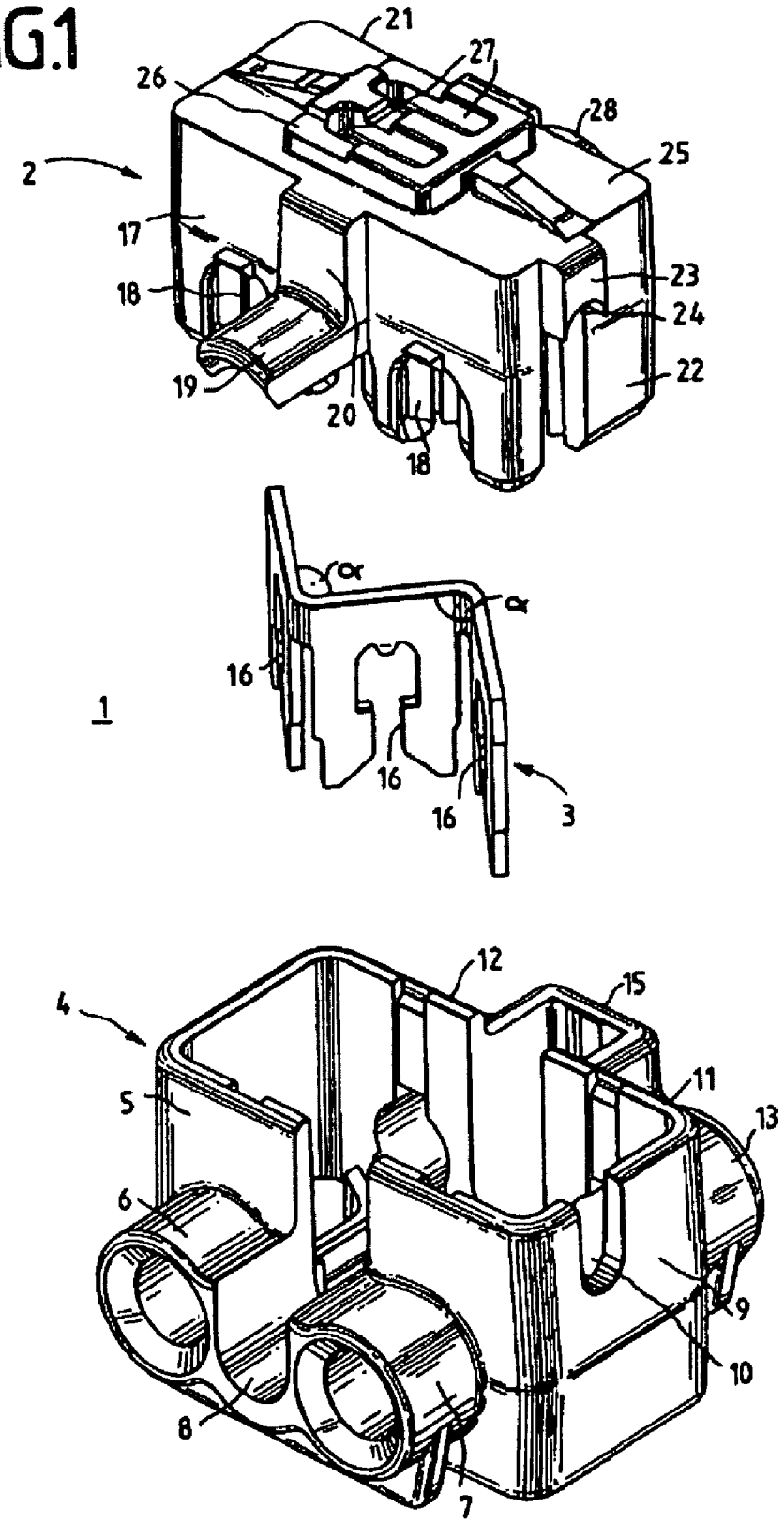
FIG. 1 shows an exploded view of a connection module.

The connection module 1 comprises a housing upper part 2, a contact element 3 and a housing lower part 4. The housing lower part 4 and housing upper part 2 form first and second parts of the housing respectively. The housing lower part 4 has a front end face 5 on which two cylindrical projections 6 and 7 are arranged. These projections 6, 7 each bounding an opening in the interior of the housing lower part 4. A partially-open cylindrical projection 8 is disposed between the two cylindrical projections 6 and 7. The end face 5 is open in the region above cylindrical projection 8. Cylindrical projections 6, 7 and 8 bound openings, disposed in-line, such that cylindrical projections 6 and 7 bound the outer openings, with partially-open cylindrical projection 8 partially bounding the opening therebetween.

Figure 4:
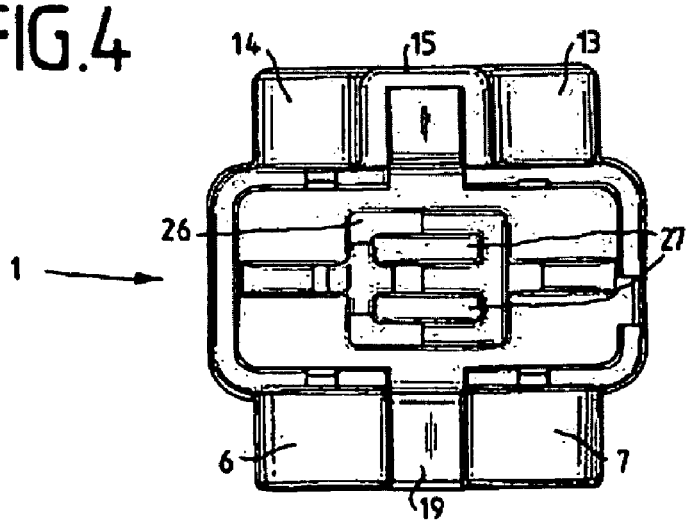
FIG. 4 shows a plan view of the connection module of FIG. 2.

One side wall 9 of the housing lower part 4 has an elongate slot 10 which extends as far as the upper edge 11 of the housing lower part 4. Two cylindrical projections 13 and 14 (see FIG. 4 too) are likewise arranged on the second end face 12 which is situated opposite the end face 5, said projections being oriented in a manner aligned with the cylindrical projections 6, 7. The end face 12 has a detachable wall element 15 which engages in the end face 12. In the engaged state, the wall element 15 closes the end face 12 and covers the openings which are bounded by cylindrical projections 13 and 14. The contact element 3 comprises three insulation-displacement terminal contacts 16, which are in each case at an angle of $\alpha=90°$ with respect to one another.

On its front end face 17, the housing upper part 2 has three strain relief devices 18 and an arcuate mating piece 19, which extends virtually perpendicularly from a base-like protrusion 20. In this case, mating piece 19 covers the third strain relief device. A further arcuate element 28 is arranged on end face 21, which is situated opposite end face 17. A protrusion 23, with concave indentation 24, is arranged on face 22. Furthermore, a plate-like element 26 with two elongate recesses 27 is arranged on upper face 25 of housing upper part 2.

Figure 2:
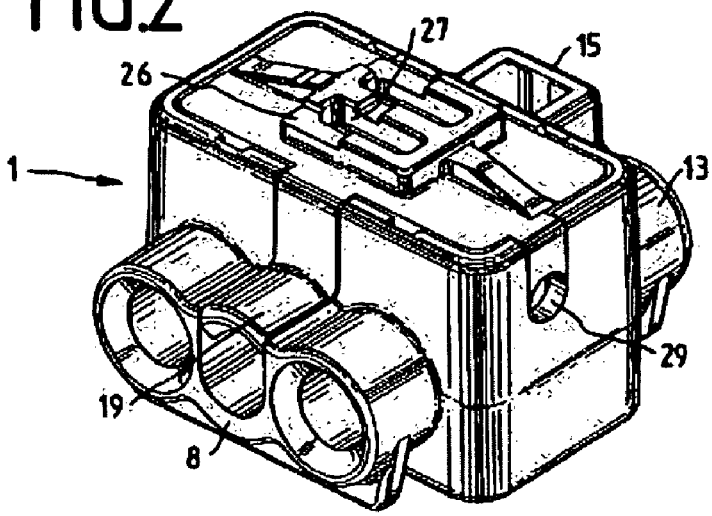
FIG. 2 shows a perspective view of the assembled connection module of FIG. 1.

The connection module 1 is then assembled by passing the wires which are to be connected into the interior of the housing lower part 4, through cylindrical projections 6 and 7 or cylindrical projection 8. The contact element 3 is then inserted into the housing lower part 4 from above. The contact element 3 is then pressed down to make contact with the wires by pressing the housing upper part 2 and the housing lower part 4 together. It should be noted here that contact element 3 can also be placed in the housing upper part 2 in advance, so that the contact element 3 then penetrates the housing lower part 4 at the same time as housing upper part 2. In order to apply adequate pressure for contact element 3 to displace wiring insulation to contact the wires thereunder, a tool can be used, for example a pair of tongs, to engage openings 27 formed in the housing upper part 2. The assembled state, illustrated in FIG. 2, shows mating piece 19 and partially-open cylindrical projection 8, forming a closed cylindrical projection 8. Furthermore, it can be seen that protrusion 23 has entered and closed slot 10, forming an aperture 29.

Figure 3:
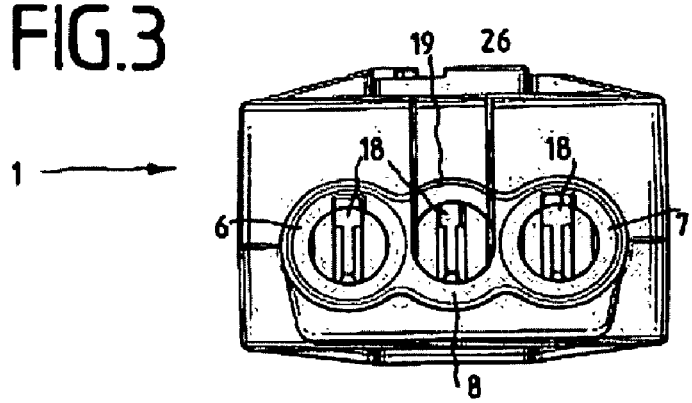
FIG. 3 shows a front view of the connection module of FIG. 2.

A front view of the connection module 1 is illustrated in FIG. 3, with the strain relief device 18 being clearly visible at the end through cylindrical projections 6, 7, 8 and 19.

Figure 5:
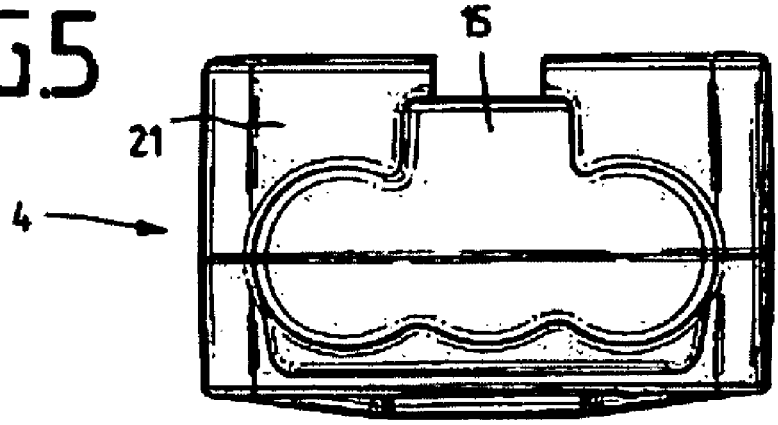
FIG. 5 shows a rear view of the housing lower part of FIG. 1.

FIG. 5 shows a rear view of the housing lower part 4, with the detachable wall element 15 being visible. As can be seen, the shape of wall element 15 is such that cylindrical projections 13 and 14 are closed. Therefore, no wires can be passed through end face 12 when wall piece 15 is engaged thereto. The wires which are to be connected are therefore terminated in the connection module 1. In this case, wall element 15 provides electrical insulation against the surroundings. However, there are possible applications for which it may be advantageous to make contact with at least one continuous wire. In such applications, the detachable wall element 15 is removed exposing continuous channels from end face 5 to end face 12. Therefore, detachable wall element 15 provides effective electrical insulation when wires are terminated in the module 1 and also allows continuation of wires through the module 1 to provide an electrical tapping capability. In addition, the connection module 1 permits tapping to a completely laid wire, by use of opposite partially-open cylindrical projection 8 from which taps may be created through the remaining two other insulation-displacement terminal contacts. Furthermore, when housing upper part 2 and lower part 4 are coupled, contact element 3 is accessible from the outside by means of aperture 29, formed by protrusion 23 entering and closing slot 10, (see FIG. 2) for test purposes and the like.

Figure 6:
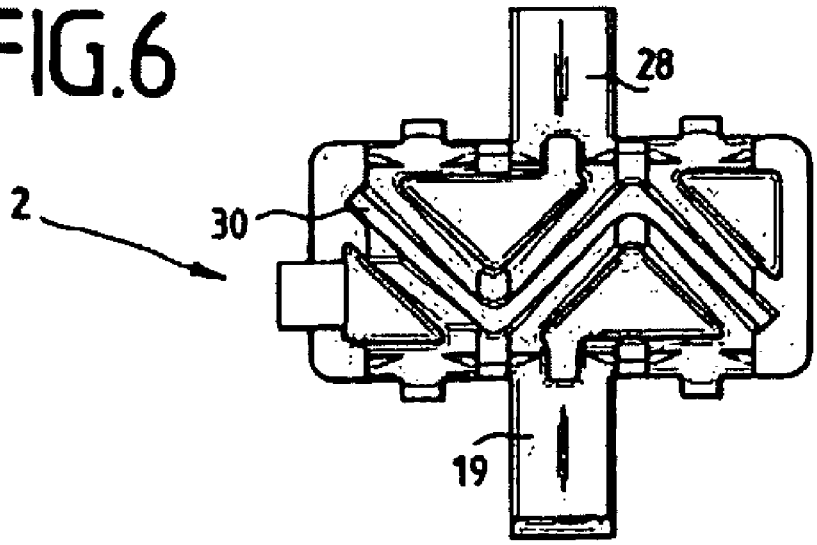
FIG. 6 shows a view of the housing upper part of FIG. 1, from below.

Finally, FIG. 6 illustrates a view of housing upper part 2 from below, it being possible to see a groove 30 for the contact element 3. The shape of the contact element 3 ensures stability, with the insulation-displacement terminal contacts 16 cutting the wires at an angle of 45° in each case, this providing a particularly good contact.

Figure 7:
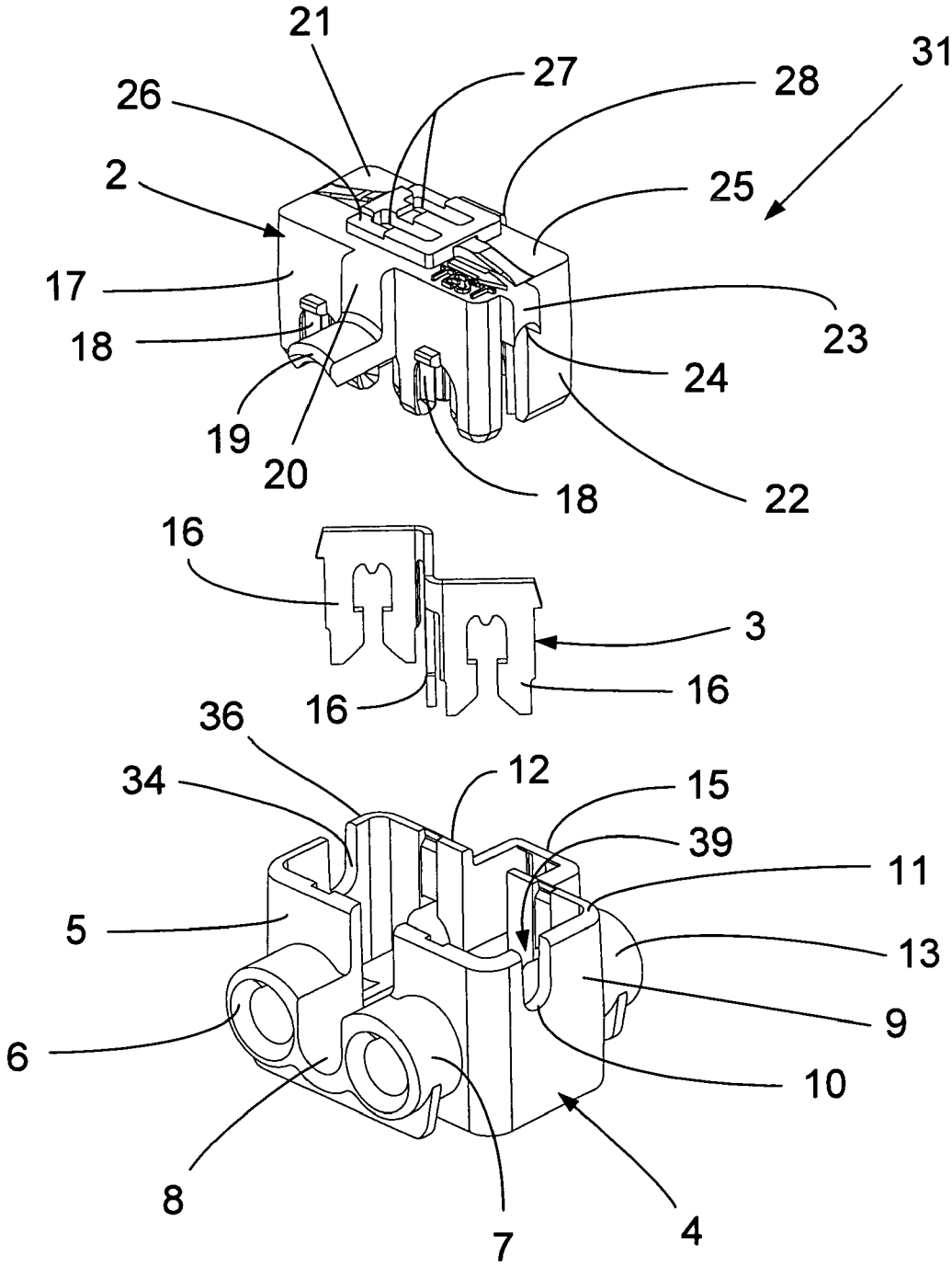
FIG. 7 shows an exploded perspective view of another connection module.

Referring now to FIG. 7, another connection module 31 is illustrated. Module 31 functions in an analogous manner to that of module 1 and like parts are designated with like reference numerals.

The housing lower part 4 of the connection module 31 includes an additional slot 34 provided in second side wall 36, opposite to side wall 9. The two slots 10, 34 of the connection module 31 replace the single slot 10 of the connector module 1.

Figure 8:
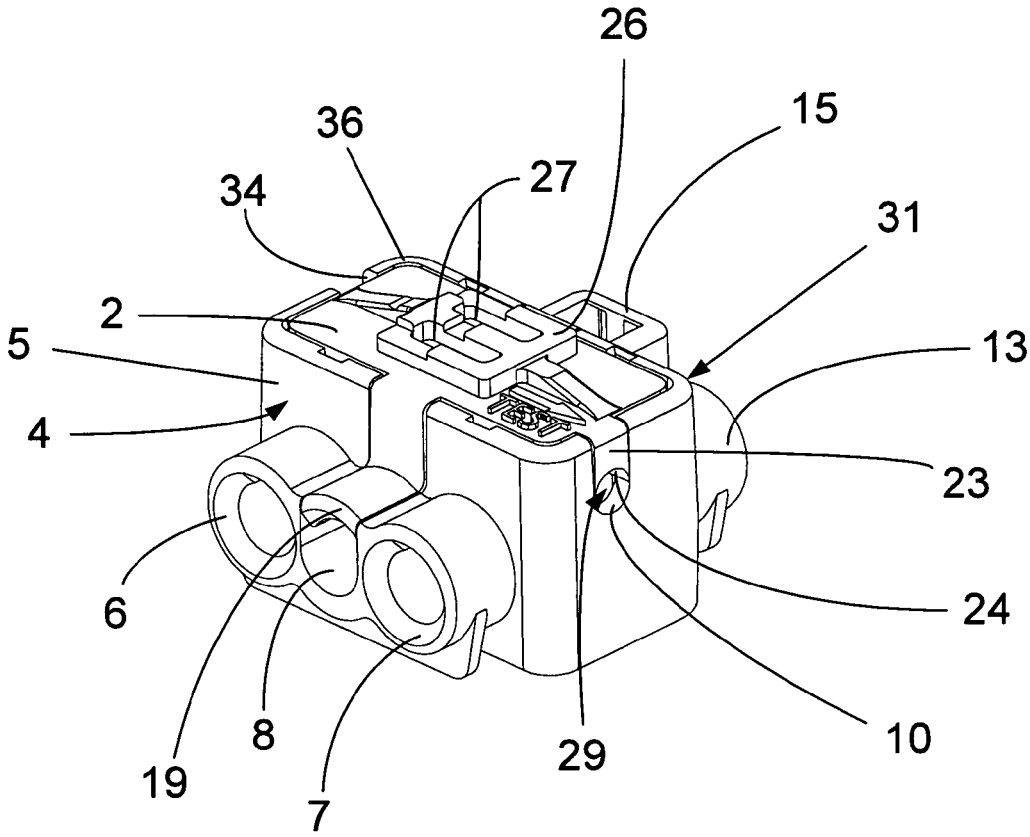
FIG. 8 shows a perspective view of a module of FIG. 7, assembled in a first condition.

In the configuration shown in FIG. 8, the housing upper part 2, is fitted together with the housing lower part 4 such that the protrusion 23, adjacent concave recess 24, is received in the slot 10 to fill an open end 39 and thereby define the aperture 29. The aperture 29 registers with the recess 24 in order to provide access to the contact element 3 for testing purposes.

The provision of the slot 10 in the side wall 9 of connector module 1 allows the housing upper part 2 to engage the housing lower part 4 only in the above described configuration. However, the provision of the second slot 34 in the opposite side wall 36 of the housing lower part 4 of the connection module 31 allows the housing upper part 2 to also engage the housing lower part 4 in a second configuration. In particular, the orientation of the housing upper part 2 may be reversed.

Figure 9:
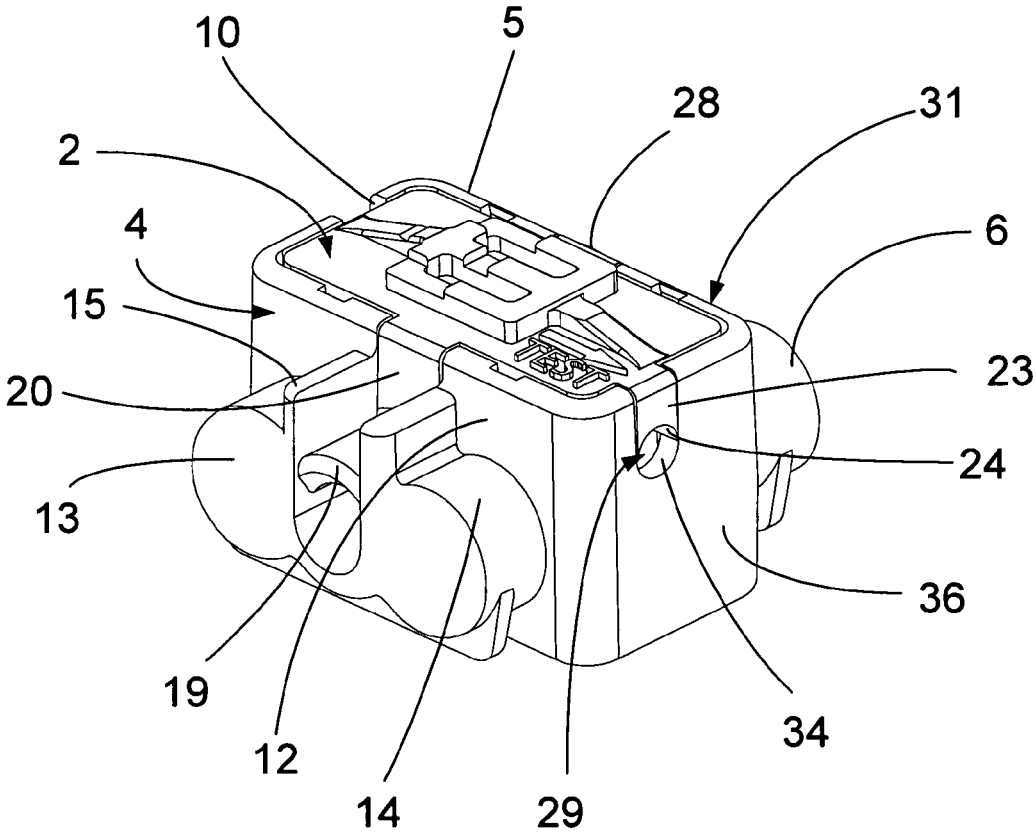
FIG. 9 shows a perspective view of a module of FIG. 7, assembled in a second condition.

In the example shown in FIG. 9, the wall element 15 of the housing lower part 4 has been removed, and the housing upper part 2 has been arranged such that the protrusion 23 is received in the second slot 34. The aperture 29 is thereby defined in the side wall 36, which registers with the indentation 24 to allow access to the element 3 from an opposite side of the connection module 31. In that configuration, the mating piece 19 and protrusion 20, which projected from the first end face 5 of the module 31 in the arrangement shown in FIG. 8, instead fit in the space provided by the removal of the wall element 15, and project rearwardly from the opposite second end face 12. Preferably the wall element 15 need not be removed to properly couple the parts 2, 4 of the module 31 together.

The housing upper part preferably includes a second protrusion (not shown) which is received in the second slots 34 to at least partially fill an open end of the slot 34. The second protrusion thereby inhibits access to the contact element 3.

It may be appreciated the above described connection module 31 increases the versatility of the connection module 1 and, further, renders the connection of the fitment of the housing upper part 2 to the housing lower part 4 universal in so far as reverse configurations are possible without losing the functionality of the aperture providing access to the contact element 3 for testing purposes and the like.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

LIST OF REFERENCE SYMBOLS

1 Connection module
2 Housing upper part
3 Contact element
4 Housing lower part
5 End face
6 Cylindrical projection
7 Cylindrical projection
8 Cylindrical projection
9 Side wall
10 Slot
11 Upper edge
12 End face
13 Cylindrical projection
14 Cylindrical projection
15 Wall element
16 Insulation-displacement terminal contact
17 Front end face
18 Strain relief devices
19 Mating piece
20 Protrusion
21 End face
22 Face
23 Protrusion
24 Indentation
25 Upper face
26 Plate-like element
27 Recess
28 Arcuate element
29 Aperture
30 Groove
31 Connection Module
32 First part
34 Slot
35 First side wall
36 Second side wall
37 Second part
38 Recess
39 Open end
40 First end face
41 Second end face The claims defining the invention are as follows:

1. A connection module for housing a contact element used to electrically connect wires within the module, the module being formed of first and second parts arranged to interfit so as to define a first set of openings, each being shaped to receive an end section of one of said wires for electric connection to the contact element, which pass into the module from a first end face toward an opposite second end face, the first part having first and second slots in opposed side walls, and the second part having a first protrusion which is received in a first one of the slots to at least partially fill an open end of said first one of said slots to thereby define an aperture to allow a test probe to access the contact element.

2. The connection module as claimed in claim 1, wherein the second part is reversible such that the first protrusion is adapted to be received in a second one of said slots to at least partially fill an open end of the second one of said slots to thereby define an aperture to allow a test probe to access the contact element.

3. The connection module as claimed in claim 1, wherein the second part includes a second protrusion which is received in the second one of the slots to at least partially fill an open end of said second one of said slots to thereby inhibit access to the contact element.

4. The connection module as claimed in claim 3, wherein the second part is reversible such that the first protrusion is adapted to be received in the second one of the slots to at least partially fill an open end of the second one of said slots to thereby define an aperture to allow a test probe to access the contact element; and the second protrusion is adapted to be received in the first one of the slots to at least partially fill an open end of said first one of said slots to thereby inhibit access to the contact element.

5. The connection module as claimed in claim 4, wherein the module includes a detachable wall element removably covering at least a second slot in the second end face of the module.

6. The connection module as claimed in claim 5, wherein, when the wall element is removed, a continuous section of wire can be seated in the second slot for electrical connection to the contact element.

7. The connection module as claimed in claim 5, wherein, when the wall element is in place, the second part is adapted to engage with the first part in only a first configuration in which the protrusion registers with the first slot.

8. The connection module as claimed in claim 5, wherein, when the wall element is removed, the second part is adapted to engage with the first part in either a first configuration in which the protrusion registers with the first slot, or a second configuration in which the protrusion registers with the second slot.

* * * * *